United States Patent [19]

Gray

[11] 4,451,765

[45] May 29, 1984

[54] RESONANCE LAMP

[75] Inventor: Lawrence H. Gray, Tottenham, Canada

[73] Assignee: Moniteq Ltd., Concord, Canada

[21] Appl. No.: 381,649

[22] Filed: May 24, 1982

[51] Int. Cl.[3] ..... H05B 41/24

[52] U.S. Cl. ..... 315/248; 313/550; 313/556; 313/607; 313/634; 315/267

[58] Field of Search ..... 315/248, 267; 313/550, 313/556, 562, 564, 607, 634

[56] References Cited

U.S. PATENT DOCUMENTS

| | | | |
|---|---|---|---|
| 3,851,214 | 11/1974 | Young | 315/267 |
| 4,002,922 | 1/1977 | Young | 315/248 X |
| 4,013,913 | 3/1977 | Driscoll et al. | 313/242 |
| 4,024,431 | 5/1977 | Young | 315/248 |

OTHER PUBLICATIONS

"Magnetic Field-Modulated, Ultraviolet-Resonance Absorption NO Analyser", (Kikuchi), Applied Optics, vol. 13, No. 2, Feb. 1974.

"A New Type of Hydrogen Discharge Tube", (Dieke & Cunningham), Journal of the Optical Society of America, vol. 42, No. 3, Mar. 1952.

"Experimental Evidence of the Photochemical Instability of a Pure $CO_2$ Planetary Atmosphere", (Felder, Morrow and Young), Journal of Geophysical Research, Space Physics, vol. 75, No. 34, Dec. 1, 1970.

"Reactions of $H^*(2^2P-2^2S)+H_2$ and Their D-Isotopes: An Experimental Study", (Van Volkenburgh), Sep. 1973, pp. 233-238.

*Primary Examiner*—Eugene R. LaRoche

*Attorney, Agent, or Firm*—Ridout & Maybee

[57] ABSTRACT

A resonance lamp of improved efficiency and stability is provided, using radio frequency excitation applied axially of the lamp, which is matched to the radio frequency source by making it part of an initially high Q tuned circuit resonant at the source frequency. This resonance promotes starting of the lamp, while the damping applied by the lamp circuit during running provides stabilization. A feedback circuit sensing lamp current or light output from a rare gas filling of the lamp provides longer term stability. The lamp may include a heated side arm containing a source of molecular gas which can be excited to provide radiation from an atomic species of interest, and the heating of the side arm is controlled not only by feedback from a temperature sensor but also by feedback from an optical detector sensitive to the radiation of interest.

8 Claims, 3 Drawing Figures

RESONANCE LAMP

FIELD OF THE INVENTION

This invention relates to resonance lamps used to provide sources of light (usually ultraviolet light) at predetermined wavelengths for use in measuring instruments.

BACKGROUND OF THE INVENTION

A primary use of this type of resonance lamp is in upper atmospheric research, in which the lamp forms part of a rocket payload. It follows that it is of the utmost importance that the lamp operates reliably, with a stable output of high and uniform intensity and minimum power consumption.

A lamp which has been used in this type of application is that of which certain embodiments are described in U.S. Pat. No. 3,851,214 issued Nov. 26, 1974 to Robert A. Young. This lamp is powered by a radio-frequency oscillator capacitively coupled to a cylindrical lamp cavity by an external cylindrical sheath and a concentric central electrode extending axially into a re-entrant tube within the cavity. The resulting radial excitation probably facilitates starting of the lamp, since it minimizes the dimension of the lamp cavity over which the electric field is established, but conversely it limits the proportion of energy escaping from the lamp relative to that lost into the walls due to electron collision. It is difficult to maintain a stable discharge; the design requires much know-how and critical adherence to manufacturing standards if its performance is to be optimized, and even then its efficiency is relatively low and its stability has been questioned. Moreover, the geometry of the lamp renders the discharge inherently non-uniform.

U.S. Pat. No. 4,013,913 issued Mar. 22, 1977 to Driscoll et al shows a lamp in which the excitation is applied axially by means of electrodes in the form of rings surrounding respectively one end of the body of the lamp and a window at the other end of the lamp. The lamp cavity is divided into two parts by a diaphragm having a capillary extending towards the window which collimates the light output. Such a structure also has a very low efficiency because of the internal structure within the lamp, and provides a source of very small effective size.

SUMMARY OF THE INVENTION

The object of the present invention is to provide a resonance lamp assembly in which a higher efficiency and more stable and uniform light output can be obtained. With this in view, an axial excitation field is utilized, in conjunction with external feedback circuits to ensure proper starting and stable operation, and the lamp itself is incorporated in an initially high-Q resonant output circuit matched to a source of radio-frequency electrical energy.

According to the present invention, a resonance lamp system comprises a hollow body of dielectric material defining a main lamp cavity free of internal obstructions, and at least one side arm having a cavity communicating with the main lamp cavity, one such side arm containing a getter, a high purity rare gas filling the body and having a pressure greater than 2 Torr, a window in the body at at least one end of the main lamp cavity transverse to an optical axis of the latter and transparent to light of desired wavelengths to be produced by the lamp, first and second electrodes disposed in planes transverse to the optical axis outside and at opposite ends of the main lamp cavity, a source of electrical energy at radio frequency, and a matching network connecting the source to said electrodes whereby to incorporate the electrodes into a high-Q circuit resonant at the frequency of the source. Preferably the system further includes means to sense a parameter proportional to the real component of the current between the electrodes and to generate a signal proportional thereto, and means to change the amplitude of the radio frequency source in response to a change in amplitude of the signal in an opposite sense whereby to maintain the intensity of the lamp substantially constant.

Where it is desired that the lamp should emit radiation at wavelengths characteristic of an atomic gas, the system further includes a heat-dissociable chemical source of molecular gas in one side arm of the body, a heater surrounding said side arm, means to sense the intensity of light generated within the lamp at least one wavelength characteristic of the atomic gas and to generate a further signal proportional to that intensity, and means responsive to the further signal to control said heater so as to change a mean temperature of the arm in an opposite sense to any change in the amplitude of the further signal.

The above features enable a lamp system to be provided which is of improved efficiency, which is easy to start and which is stable in operation. By incorporating the electrodes into a high-Q resonant circuit, peak potentials can be readily developed across the electrodes sufficient to ensure rapid and easy starting. When the lamp strikes, the real component current passing between the electrodes will damp the resonant circuit, reducing its Q and thus the potential across the electrodes so as to provide proper operating conditions. By monitoring a parameter proportional to this real current component, a feedback signal can be obtained which may be used to control the amplitude of the radio-frequency source, conventionally an oscillator, so as to maintain a substantially constant lamp output. The real current component may be monitored either directly, or preferably indirectly by monitoring the light output of the lamp at a frequency or frequencies characteristic of the rare gas utilized. Similarly, by monitoring the light output of the lamp at a frequency or frequencies characteristic of atoms of the molecular gas, the heating of the source of that gas in the side arm of the lamp may be controlled so as to maintain a substantially constant concentration of the molecular gas within the lamp.

Further features of the invention will become apparent from the following description of a preferred embodiment thereof with reference to the accompanying drawings.

SHORT DESCRIPTION OF THE DRAWINGS

Figure 1:
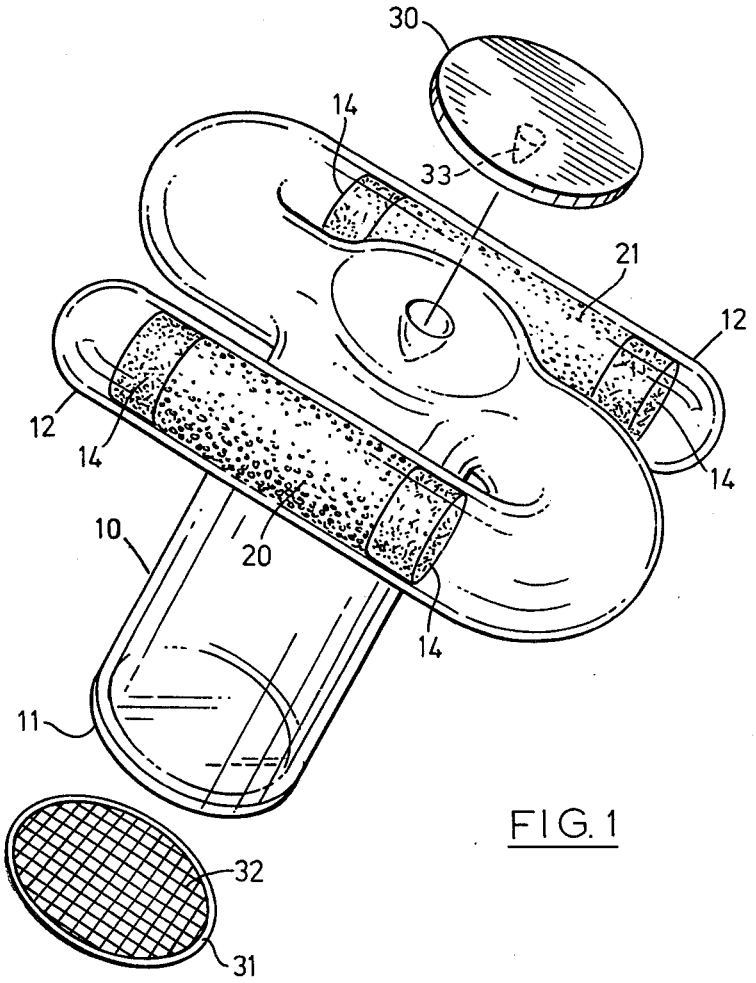
FIG. 1 is a perspective, partially exploded view of a lamp and its associated electrodes.
Figure 2:
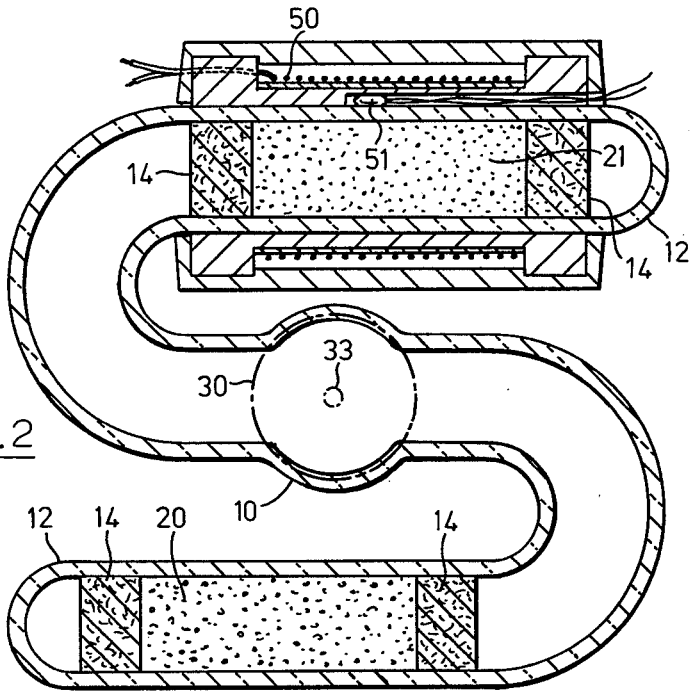
FIG. 2 is a radial cross-section through the lamp, also showing a heating element applied to one arm.
Figure 3:
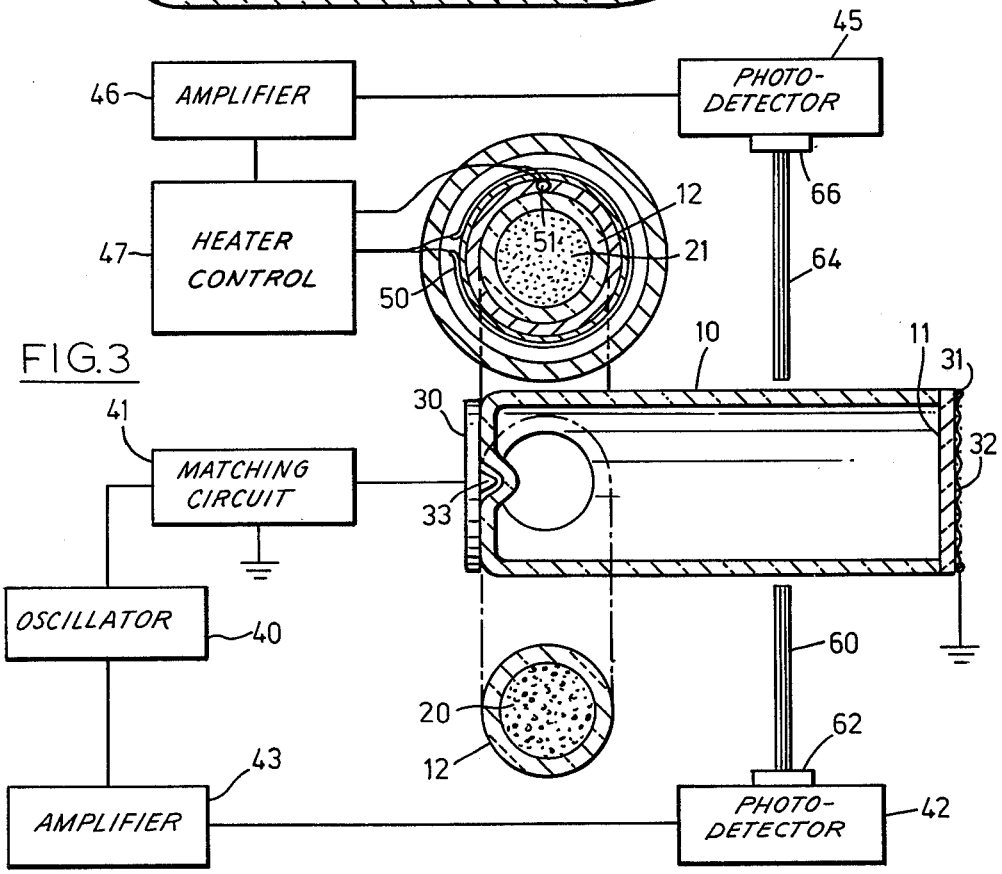
FIG. 3 is an axial section through the lamp, showing in block form the remainder of a system in which it is incorporated.

Referring to the drawings, the lamp proper comprises a hollow body of dielectric material, in practice glass, having a cylindrical portion 10 defining an unobstructed main lamp cavity, and two side arms 12 extending laterally from a closed end of the cylindrical portion and bent around to provide a more compact structure. One arm contains a solid chemical source 21 of a molecular gas, held in place between porous bungs 14, whilst the other arm contains a gettering material 20, also held in place between porous bungs 14. In each case the choice of getter and molecular gas source will depend upon the intended application of the lamp. For an oxygen lamp, for example, the gas source may be potassium permanganate, and the getter may be barium formed by thermal dissociation of barium azide: it should be understood however that the choice of gas source and getter goes not form part of the present invention. The other end of the cylindrical portion 10 is closed by a window 11 transparent to the radiation of interest. Typically this window is of magnesium fluoride, which has a high transparency in the ultraviolet region.

During manufacture, the gas source and getter and the bungs 14 are installed in the side arms 12, and the lamp is pumped down to a vacuum of better than $10^{-4}$ Torr whilst it is subjected to conventional outgassing techniques to remove adsorbed gases, and the side arm containing the getter is heated to dissociate the barium azide, after which the lamp is filled with a rare gas, typically helium, to a pressure of in excess of 2 Torr, preferably about 7 Torr, referred to 20° C.

The side arm 12 containing the gas source is surrounded by a resistance heater 50, wound on a bobbin which also houses a thermocouple or other temperature sensing device 51 adapted to sense the temperature of the arm 12. The lamp is mounted in a housing appropriate to its intended application, with a first electrode 31 adjacent the window 11 and a second electrode 30 adjacent the opposite end of the cylindrical portion so that the main lamp cavity is subjected to an axial electrical field. In order to improve the uniformity of the field, the electrode 31, which is ring shaped, may be provided with a conductive mesh 32 extending across the window. The electrode 30 may be disc shaped, and preferably has at least one pointed projection such as 33 to provide local intensification of the electric field such as will assist starting of the lamp. The projection may be housed in a dimple in the adjacent end wall of the lamp.

Energization of the lamp is by means of a radio frequency source in the form of an oscillator 40 which is coupled to the electrodes via ground and via a matching circuit 41 which forms, with the capacitor formed by the electrodes 30 and 31 and the lamp portion 10, a high-Q (prior to striking of the lamp) resonant circuit tuned to the oscillator frequency. As a result of this resonance, the peak-to-peak potential between the electrodes 30 and 31 will rise to a high level sufficient to strike the lamp, whereafter the damping applied by the current flow through the lamp will cause the potential to fall to a level such as to take up the output of the oscillator whilst maintaining a stable discharge. The lamp is thus both self-starting and self-regulating.

Longer term stability of the discharge is secured by monitoring the real component of the lamp discharge current, either by monitoring the R.F. circuit through the connection to the electrode 30 by means of a pick-up loop around the conductor and a detector, or preferably by monitoring the light output from the lamp at a wavelength characteristic of the rare gas filling. For this purpose, sensitive photodetector 42 samples the light output of the lamp through a fibre optic light guide 60 and a filter 62 which will pass at least one wavelength characteristic of the rare gas whilst blocking wavelengths characteristic of atoms of the molecular gas. Whichever way the current is monitored, the detected signal is applied to an amplifier 43 and the amplified signal is used to control the amplitude of the oscillator in a negative feedback loop.

The arrangements so far described stabilize the operation of the lamp so far as the excitation of the rare gas filling is concerned. However, the radiation of interest is that due to atoms of the molecular gas generated by heating of the side arm containing the gas source, the concentration of the gas being determinative of the intensity and optical thickness of the wanted radiation.

To provide short term stability of radiation intensity the temperature of the arm 12 containing the gas source is sensed by the heat sensor 51, the output of which is used to control the output of a heater control circuit 47 which energizes the heating coil 50 so as to maintain the temperature of the arm at a reference level. Longer term stability is provided for by a second feedback loop utilizing a photodetector 45 to sense the output of the lamp at at least one wavelength characteristic of the wanted radiation, the light output being sampled through a fibre optic light guide 64 and a filter 66 which will pass the radiation to be sensed but block radiation from the rare gas filling. The detector output is amplified in amplifier 46 and utilized to control the reference level at which the thermostat maintains the temperature. In order to ensure stability of operation, the time constant of the optical feedback circuit incorporating the photodetector 45 should be long compared with that of the thermal feedback circuit incorporating the heat sensor 51.

The electronics of the various blocks whose function has been described will not be discussed in detail, since suitable implementations will be apparent to those skilled in the art. The oscillator 40 may be constructed so that its output is controlled by altering its power supply voltage, the amplifier 43 forming a current regulator for the power supply to the oscillator which descreases the current applied to the oscillator with increase in the feedback signal. A similar technique is used to control the heater, although in this case the heater control circuit 47 receives inputs both from the temperature sensor 51 and from the amplifier 46, those dual inputs conveniently being applied through a differential amplifier. It will of course be understood that each of the various feedback loops is provided with means for establishing appropriate reference levels with respect to which control is exercised, whilst the time constants of the circuits are chosen with due regard to the characteristics of the loop components and the interaction of the loops to obtain stable operation without either hunting or an unreasonably long settling time.

In some applications it may be required to provide a pulsed output from the lamp. The easy and rapid starting provided by the lamp system of the invention is a great advantage in such applications, but the time constants of the optical feedback circuits in such applications must be very long compared to the pulse rate.

Whilst the invention has been described with reference to an oxygen resonance lamp, it will of course be understood that it is equally applicable to lamps in which other atomic species emit the desired radiation, such as nitrogen, halogen and hydrogen lamps. In the last case, only a single arm 12 is needed, since the same system, comprising uranium hydride formed in situ from excess uranium metal, can act both as gas source and getter. Furthermore, certain aspects of the invention are applicable to rare gas lamps, in which only the rare gas filling is present and the arm 12 containing the gas source is not required. In this last case, it will be understood that the heater 50 and its associated control components would also be omitted.

What I claim is:

1. A resonance lamp system comprising a hollow body of dielectric material defining a main lamp cavity free of internal obstructions, and at least one side arm having a cavity communicating with the main lamp cavity, one such side arm containing a getter, a high purity rare gas filling the body and having a pressure greater than 2 Torr, a window in the body at at least one end of the main lamp cavity transverse to an optical axis of the latter and transparent to light of desired wavelengths to be produced by the lamp, first and second electrodes in planes transverse to said optical axis outside and at opposite ends of the main lamp cavity, a source of electrical energy at radio frequency, and a matching network connecting the source to said electrodes whereby to incorporate the electrodes into a high-Q circuit resonant at the frequency of the source.

2. A resonance lamp system according to claim 1, further including means to sense a parameter proportional to the real component of the current between the electrodes and to generate a signal proportional thereto, and means to change the amplitude of the radio frequency source in response to a change in amplitude of the signal in an opposite sense whereby to maintain the intensity of the lamp substantially constant.

3. A resonance lamp system according to claim 2, wherein the parameter sensing means senses the intensity of light generated within the lamp at at least one wavelength characteristic of the rare gas.

4. A resonance lamp system according to claim 3, wherein the sensing means comprises a light guide extending to a transparent portion of the body adjacent the main lamp cavity, a filter passing at least one wavelength characteristic of the rare gas, and a photosensor sensitive to that wavelength.

5. A resonance lamp system according to claim 1, 2 or 3, including a heat-dissociable chemical source of molecular gas in one side arm of the body, a heater surrounding said side arm, means to sense the intensity of light generated within the lamp at at least one wavelength characteristic of dissociated atoms of the molecular gas and to generate a further signal proportional to that intensity, and means responsive to the further signal to control said heater so as to change a mean temperature of the arm in an opposite sense to any change in the amplitude of the further signal.

6. A resonance lamp system according to claim 1, 2 or 3, including a heat-dissociable chemical source of molecular gas in one side arm of the body, a heater surrounding said side arm, means to sense the intensity of light generated within the lamp at at least one wavelength characteristic of dissociated atoms of the molecular gas and to generate a further signal proportional to that intensity, means responsive to the further signal to control said heater so as to change a mean temperature of the arm in an opposite sense to any change in the amplitude of the further signal, and means to sense the temperature of the arm and to generate a signal proportional to that temperature, the means to control said heater being responsive to said temperature signal to maintain said mean temperature.

7. A resonance lamp system according to claim 1, 2 or 3, including a heat-dissociable chemical source of molecular gas in one side arm of the body, a heater surrounding said side arm, means to sense the intensity of light generated within the lamp at at least one wavelength characteristic of dissociated atoms of the molecular gas and to generate a further signal proportional to that intensity, means responsive to the further signal to control said heater so as to change a mean temperature of the arm in an opposite sense to any change in the amplitude of the further signal, and means to sense the temperature of the arm and to generate a signal proportional to that temperature, the means to control said heater being responsive to said temperature signal to maintain said mean temperature, the rate of response of said control means to said further intensity responsive signal being slower than its response to said temperature signal.

8. A resonance lamp system according to claim 1, 2 or 3, including a heat-dissociable chemical source of molecular gas in one side arm of the body, a heater surrounding said side arm, means to sense the intensity of light generated within the lamp at at least one wavelength characteristic of dissociated atoms of the molecular gas and to generate a further signal proportional to that intensity, and means responsive to the further signal to control said heater so as to change a mean temperature of the arm in an opposite sense to any change in the amplitude of the further signal, wherein the light intensity sensing means comprises a light guide extending to a transparent portion of the body adjacent the main lamp cavity, a filter passing at least one wavelength characteristic of the molecular gas, and a photosensor sensitive to that wavelength.

* * * * *